United States Patent [19]

Allen et al.

[11] 4,447,708

[45] May 8, 1984

[54] ASSEMBLY FOR USE IN THE SPARK PERFORATION OF SHEET MATERIAL

[75] Inventors: Roger A. Allen, Gt. Missenden; Robert J. Hall, Flackwell Heath, Nr. High Wycombe, both of England

[73] Assignee: The Wiggins Teape Group Limited, England

[21] Appl. No.: 279,192

[22] Filed: Jun. 30, 1981

[30] Foreign Application Priority Data

Jul. 9, 1980 [GB] United Kingdom ..... 8022453

[51] Int. Cl.[3] ..... H05B 7/18

[52] U.S. Cl. ..... 219/384; 83/16; 83/70; 131/281; 162/261

[58] Field of Search ..... 219/383, 384, 121 EB; 131/281, 284; 83/16, 70; 162/139, 261

[56] References Cited

U.S. PATENT DOCUMENTS

| | | | |
|---|---|---|---|
| 3,167,641 | 1/1965 | Parmele | 219/384 |
| 3,385,951 | 5/1968 | Bancroft | 219/384 |
| 3,385,966 | 5/1968 | Rosenthal | 219/383 |
| 4,110,396 | 7/1978 | Martin | 219/384 |

*Primary Examiner*—B. A. Reynolds
*Assistant Examiner*—Geoffrey S. Evans
*Attorney, Agent, or Firm*—Burns, Doane, Swecker & Mathis

[57] ABSTRACT

A spark perforation apparatus includes a rotary electrode assembly for effecting spark perforation of sheet material passing between the electrodes of the assembly and a suitably juxtapositioned earthed surface. The electrode assembly comprises a first set of annular electrodes for connection to a suitable power source, a second set of annular electrodes alternating with and of greater external diameter than the electrodes of the first set, and dielectrical material spacing the electrodes so as to form a series of parallel capacitors.

10 Claims, 12 Drawing Figures

VII

Figure 1:
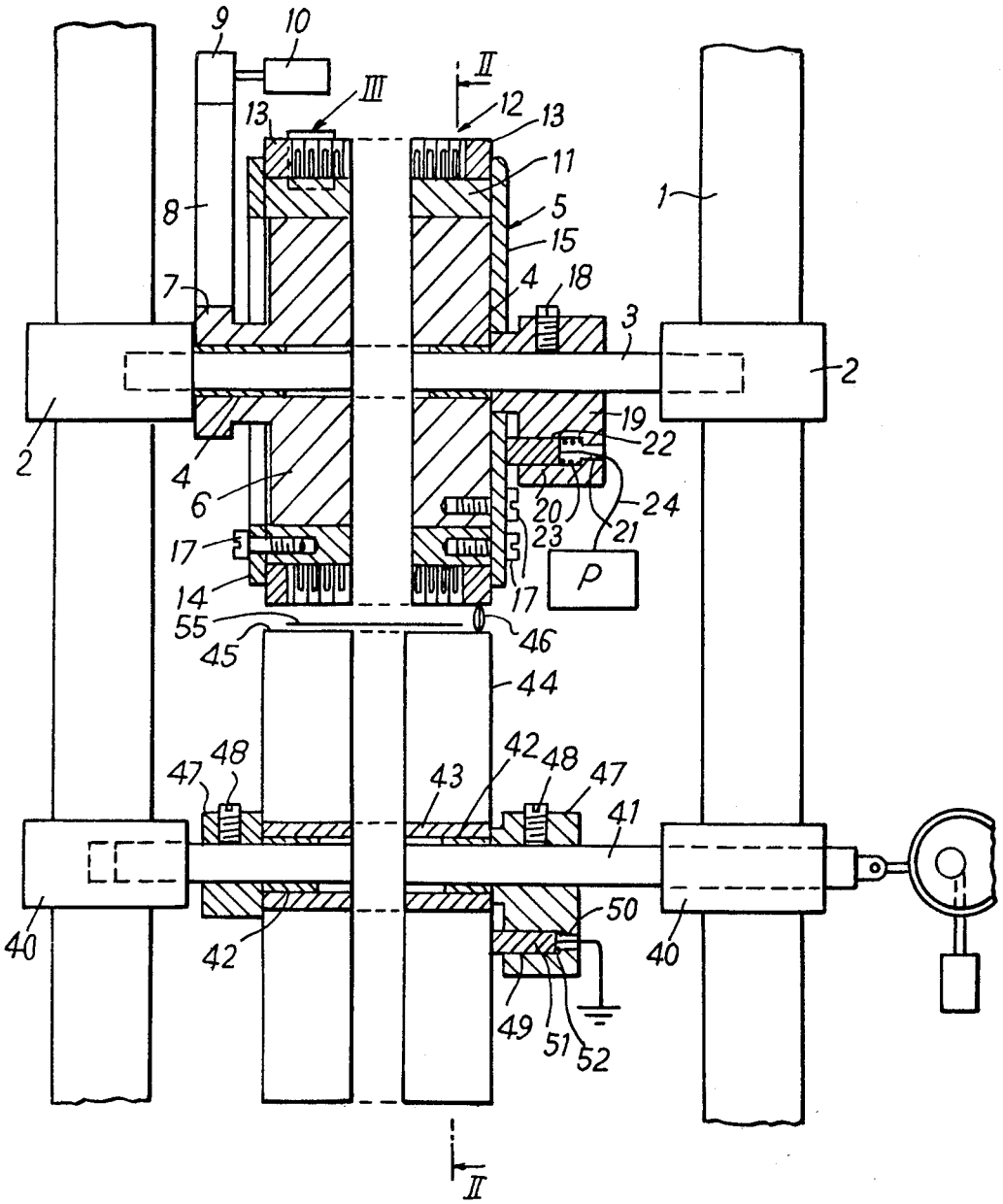

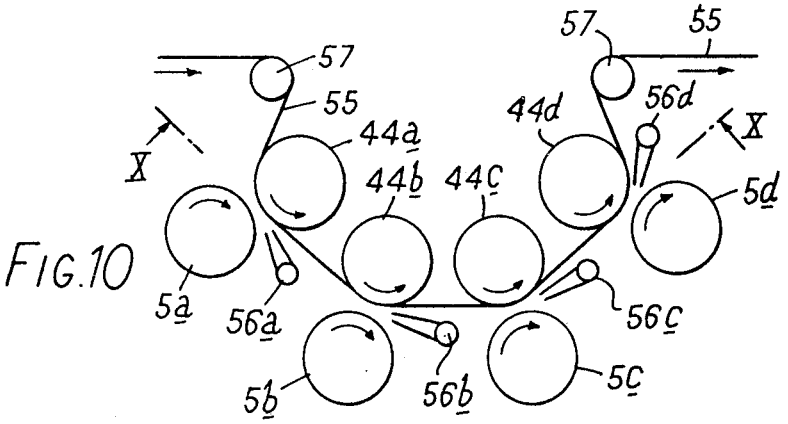
FIG.10
FIG.11
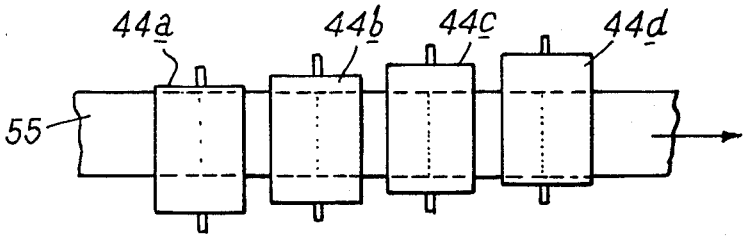
FIG.12
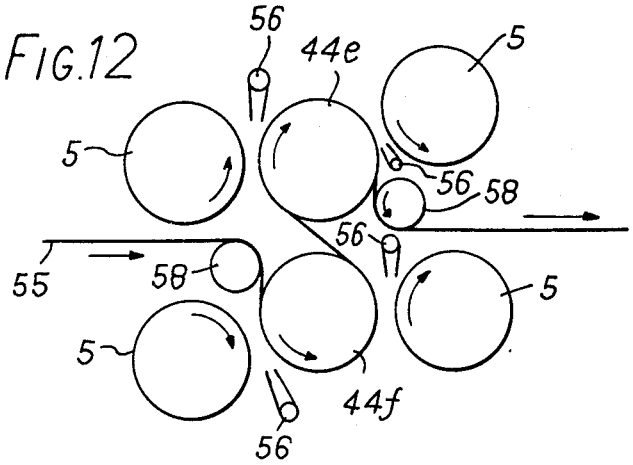

ASSEMBLY FOR USE IN THE SPARK PERFORATION OF SHEET MATERIAL

This invention relates to an assembly for use in the spark perforation of sheet material, and particularly but not exclusively, of cigarette tissue.

The electrode assemblies currently in use mostly consist of banks of pin type electrodes juxtaposed in relation to an earthed surface across which is passed the material to be perforated. Arcs are struck between the pin electrodes and the earthed surface so that the sheet material is perforated. The use of pin electrodes however is inconvenient in that they suffer from rapid erosion, often at an uneven rate. As a result, they need frequent replacement.

It is among the objects of the present invention to provide a electrode assembly which obviates this problem by avoiding the use of pin electrodes.

The invention therefore provides a rotary electrode assembly for use in effecting the spark perforation of sheet materials passing between the electrodes of the assembly and a suitably juxtapositioned earthed surface, said assembly comprising a first set of annular electrodes for connection to a suitable power source, a second set of annular electrodes alternating with and of greater external diameter than the electrodes of the first set, and dielectric material spacing said electrodes so as to form a series of parallel capacitors.

The first set of electrodes may be of any suitable material, for example of spring steel, and are preferably formed with rounded outer peripheries so as to prevent the development of stress points which result from the presence of sharp edges.

Each of the first set of electrodes is preferably housed in an annulus of dielectric material and formed somewhat in the manner of an internal circlip so as to be capable of being sprung easily in to an inwardly facing recess in the annulus.

The second set of electrodes may each comprise a flat annular ring of metallic material which is resistant to erosion when subject to a temperature of an electric arc. The second electrodes may for example be made of alloys well known for the manufacture of spark plug electrodes. Each annulus of dielectric material receiving one of the first set of electrodes may also be stepped on one radial face adjacent to the outer periphery so as to receive one of the second set of electrodes in flush relation with the remainder of the face.

In another aspect, the invention provides an apparatus for effecting the spark perforation of sheet materials, comprising a rotor, including an electrode assembly as hereinbefore defined, mounted for rotation about a first axis, and a backing roll mounted for rotation about a second axis parallel to said first axis and having a conductive circumferential surface, the circumferential surfaces of the rotor and backing roll defining a spark gap through which sheet material can be passed for perforation by sparks generated by the application of a suitable electrical potential between the first electrodes and the circumferential surface of the backing roll.

Various drive means may be provided. Thus either the rotor or backing roll may be mounted for free rotation and be driven by engagement with the sheet material to be perforated whilst the other element is driven by separate drive means. Alternatively, both the rotor and backing roll may be separately driven. Either the rotor or backing roll may also be advantageously subjected to axial oscillation so that the circumferential surface of the backing roll is evenly eroded during the spark perforation process.

Figure 2:
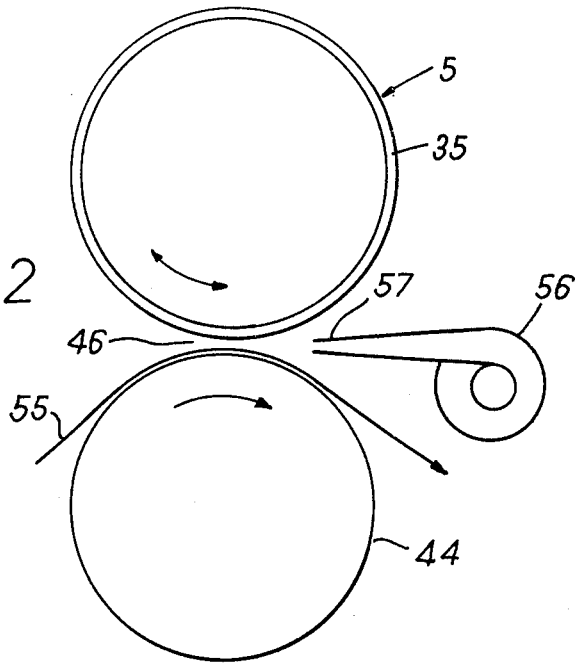
Figure 3:
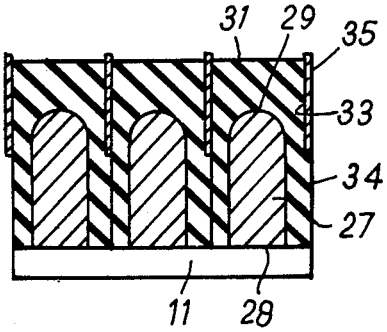
Figure 4:
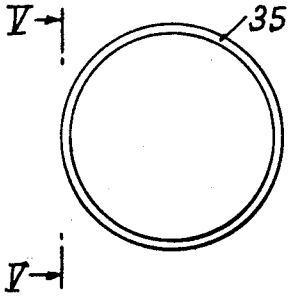
Figure 5:
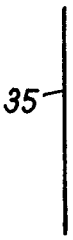
Figure 6:
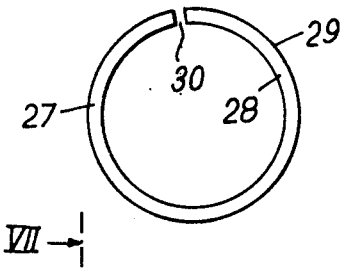
Figure 7:
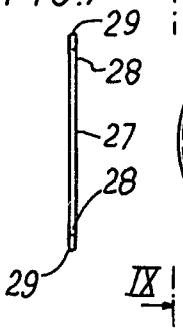
Figure 8:
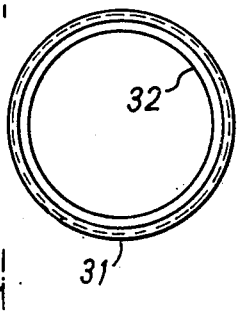
Figure 9:
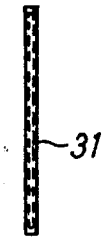

The invention will now be further described with reference to the accompanying drawings in which:

FIG. 1 is a front elevation on an apparatus for effecting spark perforation of sheet material, FIG. 2 is a diagrammatic sectional side elevation on the line II—II of FIG. 1, FIG. 3 is a enlarged view on the area indicated by the arrow III of FIG. 1, FIG. 4 is a plan view of an electrode forming part of an electrode assembly according to the invention, FIG. 5 is a side elevation on the line V—V of FIG. 4, FIG. 6 is a plan view of another electrode forming part of the electrode assembly according to the invention, FIG. 7 is a side elevation on the line VII—VII of FIG. 6, FIG. 8 is a plan view of a moulded dielectric annulus forming part of the electrode assembly according to the invention, FIG. 9 is a side elevation on the line IX—IX of FIG. 8, FIG. 10 is a diagrammatic side elevation of four sets of apparatus as shown in FIG. 1 arranged for sequential spark perforation of a strip of paper, FIG. 11 is a plan view of the line X—X of FIG. 9 and, FIG. 12 is a diagrammatic side elevation of an assembly functioning similarly to that of FIG. 10 but having a different configuration.

Referring first to FIGS. 1 and 2 of the drawings, the spark perforation apparatus shown comprises a frame 1 carrying a pair of shaft supports 2 between which a fixed shaft 3 extends. The shaft 3 carries a pair of sleeve bearings 4 on which a rotor 5 is free to rotate. The rotor 5 consists of a non-conductive core 6 having an extension 7 formed as a pulley around which a belt 8 extends from a second pulley 9 driven by a motor 10.

The core 6 carries a conductive sleeve 11 of steel or other suitable metal. The sleeve 11 in turn carries an electrode assembly 12 (described in greater detail below) mounted between two rings 13 of dielectric material.

The sleeve 11, assembly 12 and rings 13 are retained in position by an end ring 14 and a circular end plate 15, which are of an outer diameter somewhat less than that of the assembly 12. The ring 14 and end plate 15 are retained in position by set screws 17.

Fixedly mounted on the shaft 3 by means of a grub screw 18 is a block 19. The block 19 is formed with a bore 20 having an outer portion 21 of reduced diameter. The bore 20 retains a carbon brush 22 which is held against the outer face of the end plate 15 by means of a spring 23. The brush 22 has a connection 24 to a power source P operating, for example, at 20 kilovolts.

Electrode assembly 12 consists of a series of annular elements of three different kinds, three sets of which are seen in enlarged cross-section in FIG. 3. Each set comprises a first electrode 27 having a flat inner face 28 in electrical contact with the sleeve 11 and a outer periphery 29 which is rounded to avoid the development of stress points. The electrode 27, which is shown in full in FIGS. 6 and 7, is made of any suitable metal, for example spring steel, and is preferably split in the manner of an internal circlip, as at 30, to permit introduction into an annular housing as explained below.

The electrode 27 is housed in an annulus 31 of dielectric material, seen also in FIGS. 8 and 9. The annulus 31 is recessed at its inner face 32 so as to receive therein the electrode 27. Each annulus is also stepped at 33 on one radial face 34 adjacent the periphery to receive a flat ring electrode 35 which is also shown in FIGS. 4 and 5. The step 33 is dimensioned so that the electrode 35 lies flush with the face 34 of the annulus. The electrode 35 is formed from material preferably such as an alloy of the kind used in spark plug electrodes, which is resistant to erosion under arcing conditions. The electrode 35 is also of slightly greater diameter than the annulus 31 so as to allow for a limited amount of erosion.

The annulus 31 is preferably formed from a material of high dielectric strength, low dielectric loss and having low water absorbency characteristics. Suitable materials are polytetrafloroethylene, polyethylene and polystyrene.

It will be seen that each set of annular elements comprising the electrodes 27 and 35 and the dielectric annulus 31 comprise a capacitor. The assembly 12 therefore consists of a series of parallel capacitors which can be charged and discharged through the conductive sleeve 11 and the electrodes 35. It should be noted that the term electrodes is applied to both sets of annular elements which form the axially arranged capacitors. However, it is only the second set of electrodes 35 which actually discharge to effect the spark perforation of the sheet material. It will be seen from FIG. 1, that charging is effected from the power source P through the brush 22 and the end plate 15.

Also mounted on the frame 1 are a pair of bearings 40 in which a shaft 41 is journalled in parallel relation to the shaft 3 for limited axial movement. The shaft 41 carries a pair of sleeve bearings 42 on which a hollow spindle 43 of nonconducting material is freely rotatable. The hollow spindle 43 carries a conductive backing roll 44, made for example of spring steel and having a circumferential surface 45 defining a gap 46 with the assembly 12 for the generation of sparks. The gap 46 will normally be set at in the region of 250 microns but is shown of substantially greater dimensions for the sake of clarity.

The backing roll 44 is maintained in register with the electrode assembly 12 by means of a pair of blocks 47 which are secured by grub screws 48. One of the blocks 47 is formed with a bore 49 having a outer portion 50 of reduced diameter and carrying a carbon-brush 51. The brush 51 is held in engagement with the side face of the roll 44 by means of a spring 52 and is earthed as indicated in the drawing.

The paper 55 to be perforated is fed between the rotor 5 and the backing roll 44 so as to partially wrap around the roll 44. This results in the paper imparting rotation to the roll as it is drawn through the gap 46, as best seen in FIG. 2.

Rotation is imparted to the rotor 5 by means of the motor 10 in either direction, it merely being necessary that steady rotation in either sense is maintained so that the point at which sparks are generated on the electrodes 35 is continually changed.

The movement of the paper 55 through the gap 46 tends also to create an air movement in the same direction with constant movement of the charged ions forming the spark. As a result, excessively large perforations tend to be formed. In order to counteract this tendency, a blower 56 may advantageously be provided having an outlet 57 in a form of a slot extending across the gap 46 and directing air into the gap in a direction opposite the movement of the paper 56.

The diameters of the rotor 5 and backing roll 44 are variable commensurate with maintenance of rigidity over the width of paper to be perforated and, in the case of the rotor, development of sufficient capacitance in the electrode assembly. For a paper width of approximately one meter, it has been found that rotor and backing roll diameters of four inches are satisfactory. A rotor of this dimension can also accommodate an electrode assembly having each individual electrode capacitance of 11 to 25 picofarads at 20 Kilovolts peak working and with an applied frequency of 16 Kilohertz.

In order to provide a capacitance necessary in the assembly 12 to achieve satisfactory spark generation, there is a minimum spacing at which the electrodes 35 can be set in relation to the electrodes 27, and therefore to each other. This spacing is somewhat greater than the desired spacing of the perforations in the sheet material, and in order to fully perforate the material to the desired degree, a number of sets of apparatus as shown in FIGS. 1 and 2 may be provided, depending on the spacing; on the electrodes 35 and the desired spacing of the rows of perforations. FIGS. 10 and 11 show an assembly which includes four sets of apparatus, but it will be appreciated that any number may be provided according to requirements.

Turning now to FIGS. 10 and 11, these show four sets of apparatus, each comprising a rotor 5 and a backing roll 44 together with a blower 56, the respective components having been identified by the suffixes a, b, c, and d. The four sets of apparatus are arranged so that the axis of the rolls 44*a, b, c, d* lie on a curved path. Guide rolls 57 are also provided so that the sheet material, for example cigarette tissue to be perforated, is tensioned around the backing rolls and causes them to rotate as it is drawn through the assembly.

As best seen in FIG. 11, each set of apparatus is off-set with respect to the next set, the off-set in each case being one quarter of the spacing between the electrodes 35. It will be appreciated that as the cigarette tissue leaves backing roll 44*d* it will carry perforations at a spacing of one quarter of the spacing of the electrodes 35. It will be evident that any other spacing can be provided for, by varying the number of sets of apparatus provided.

Referring now to FIG. 12, this shows an assembly which functions in a similar manner to that of FIG. 10 but which has a different configuration. In the assembly shown in FIG. 12, only two backing rolls 44*e* and *f* are provided. With the cooperation of guide rolls 58, the sheet 55 is drawn around the backing rolls in an "S" configuration. Four rotors 5 and blowers 56 are provided, two of each being mounted in a juxtaposition to each of the backing rolls 44. In this case, the rotors 5 only are off-set in the manner shown in FIG. 11, the rolls 44*e* and *f* being of slightly greater length so as to accommodate the rotor off-set.

It will be appreciated that a number of other configurations may be provided apart from those shown in FIGS. 10 and 11. Thus a single large backing roll could be provided around which a number of rotors are disposed in a "sun and planet" arrangement. Other configurations will be evident to a person skilled in the art.

In the arrangement described above the sheet material is drawn through the gap between the rotor and the backing roll but, depending upon the thickness of the sheet material the gap could be such as to nip the material and feed it forward.

We claim:

1. Spark perforation apparatus including a rotary electrode assembly adapted for rotation about an axis for effecting spark perforation of sheet material passing between electrodes of the assembly and a suitably juxtapositioned earthed surface, said electrode assembly comprising a first set of annular electrodes which are annular about said axis for connection to a suitable power source, a second set of annular electrodes which are annular about said axis, individual ones of the first and second sets of electrodes alternating and being axially and radially spaced from one another along the axis, each one of the second set of electrodes having a greater external diameter than the electrodes of the first, and dielectric material which is annular about the axis and fills the axial spacing between adjacent ones of said first and second sets of electrodes to form a series of axially spaced capacitors.

2. Spark perforation apparatus as claimed in claim 1, wherein each one of the first set of electrodes is formed with a rounded radially outer periphery.

3. Spark perforation apparatus as claimed in claim 1 or claim 2 in which each of the first set of electrodes is housed in an annulus of dielectric material and is split to allow it to be sprung into an inwardly facing recess in the annulus.

4. Spark perforation apparatus as claimed in claim 1 in which the second set of electrodes each comprise a flat annular ring of metallic material which is resistant to erosion when subject to a temperature of an electric arc.

5. Spark perforation apparatus as claimed in claim 2, wherein the dielectric material is formed as individual annuli, each annulus of dielectric material receiving one of the first set of electrodes and being stepped on one radial face adjacent to the outer periphery to receive one of the second set of electrodes flush in relation to the remainder of the face.

6. Spark perforation apparatus as claimed claim 1 in which said rotary electrode assembly is incorporated in a rotor mounted for rotation about a first axis, and a backing roll is mounted for rotation about a second axis parallel to said first axis and having a conductive circumferential surface, the circumferential surfaces of the rotor and backing roll defining a spark gap through which sheet material can be passed for perforation by sparks generated by the application of a suitable electrical potential between the second set of electrodes and the circumferential surface of the backing roll.

7. Spark perforation apparatus as claimed in claim 6, wherein one of the rotor and backing roll is mounted for free rotation and is driven by engagement with the sheet material to be perforated, the other one of the rotor and backing roll being driven by separate drive means.

8. Spark perforation apparatus as claimed in claim 6 in which the rotor and backing roll are separately driven.

9. Spark perforation apparatus as claimed in claim 6 or claim 7 or claim 8 in which the rotor and backing roll are spaced to nip the sheet and feed it forwards.

10. Spark perforation apparatus as claimed in claim 6, claim 7 or claim 8 including means for effecting axial oscillation of one of the rotor and backing roll.

* * * * *